US008893338B2

(12) United States Patent
McCausland et al.

(10) Patent No.: US 8,893,338 B2
(45) Date of Patent: Nov. 25, 2014

(54) INFLATABLE CELLULAR MATTRESS WITH ALTERNATING ZONES OF INFLATED CELLS

(75) Inventors: J. David McCausland, Glen Carbon, IL (US); Paul A. Rickman, Belleville, IL (US); Dennis L. Clapper, Swansea, IL (US)

(73) Assignee: Roho, Inc., Belleville, IL (US)

( * ) Notice: Subject to any disclaimer, the term of this patent is extended or adjusted under 35 U.S.C. 154(b) by 683 days.

(21) Appl. No.: 13/279,920

(22) Filed: Oct. 24, 2011

(65) Prior Publication Data

US 2012/0036646 A1 Feb. 16, 2012

Related U.S. Application Data

(62) Division of application No. 12/682,434, filed as application No. PCT/US2008/079485 on Oct. 10, 2008.

(60) Provisional application No. 60/998,643, filed on Oct. 12, 2007.

(51) Int. Cl.

| | |
|---|---|
| ***A47C 27/10*** | (2006.01) |
| ***A47C 27/08*** | (2006.01) |
| ***A61G 7/057*** | (2006.01) |

(52) U.S. Cl.

CPC ..... *A47C 27/10* (2013.01); *A47C 27/082* (2013.01); *A61G 7/05776* (2013.01)

USPC ..... 5/713; 5/710; 5/655.3

(58) Field of Classification Search

CPC .. A47C 27/083; A47C 27/081; A47C 27/082; A47C 27/10; A61G 7/05769; A61G 7/05776

USPC ..... 5/713, 710, 706, 644, 654, 655.3

See application file for complete search history.

(56) References Cited

U.S. PATENT DOCUMENTS

| | | | | |
|---|---|---|---|---|
| 4,175,297 | A * | 11/1979 | Robbins et al. | 5/284 |
| 4,797,962 | A | 1/1989 | Goode | |
| 4,986,738 | A | 1/1991 | Kawasaki et al. | |
| 5,010,608 | A * | 4/1991 | Barnett et al. | 5/713 |
| 5,396,671 | A * | 3/1995 | Stacy | 5/655.3 |

(Continued)

FOREIGN PATENT DOCUMENTS

| | | |
|---|---|---|
| DE | 10056235 A1 | 5/2002 |
| JP | 3037924 | 6/1997 |

(Continued)

OTHER PUBLICATIONS

International Search Report and Written Opinion Application No. PCT/US2008/079485 filed Jun. 17, 2009.

(Continued)

*Primary Examiner* — Robert G Santos

(74) *Attorney, Agent, or Firm* — Polster, Lieder

(57) ABSTRACT

A cushion or mattress comprising a base and a plurality of linearly aligned individual air cells across the base. Groups of individual air cells can be interconnected and in fluid cooperation with an inflation source, such as a pump. In one aspect of the invention, the inflation of adjacent cells is staggered, for example, in a checkerboard-like inflation pattern that helps diffuse load over a wider area.

18 Claims, 12 Drawing Sheets

(56) References Cited

U.S. PATENT DOCUMENTS

| | | | | |
|---|---|---|---|---|
| 5,651,151 | A * | 7/1997 | Schild | 5/710 |
| 5,901,393 | A | 5/1999 | Pepe et al. | |
| 5,918,336 | A * | 7/1999 | Lee et al. | 5/713 |
| 6,108,843 | A | 8/2000 | Suzuki et al. | |
| 6,349,439 | B1 | 2/2002 | Cook et al. | |
| 6,474,743 | B1 | 11/2002 | Harker et al. | |
| 6,487,739 | B1 | 12/2002 | Harker | |
| 6,789,284 | B2 | 9/2004 | Kemp | |
| 6,877,178 | B2 | 4/2005 | Chapman et al. | |
| 6,928,681 | B1 | 8/2005 | Stacy | |
| 7,392,557 | B1 | 7/2008 | Kohlman | |
| 7,409,735 | B2 * | 8/2008 | Kramer et al. | 5/713 |
| 7,849,544 | B2 * | 12/2010 | Flocard et al. | 5/710 |
| 8,104,126 | B2 * | 1/2012 | Caminade et al. | 5/715 |
| 8,261,387 | B2 * | 9/2012 | Lipman et al. | 5/709 |
| 2003/0145386 | A1 * | 8/2003 | Kemp | 5/713 |
| 2003/0182728 | A1 * | 10/2003 | Chapman et al. | 5/713 |
| 2006/0085919 | A1 * | 4/2006 | Kramer et al. | 5/713 |
| 2007/0056112 | A1 | 3/2007 | Graebe | |
| 2007/0186349 | A1 * | 8/2007 | Lipman et al. | 5/713 |
| 2008/0307582 | A1 * | 12/2008 | Flocard et al. | 5/712 |
| 2009/0100604 | A1 * | 4/2009 | Caminade et al. | 5/713 |
| 2010/0205750 | A1 | 8/2010 | McCausland et al. | |
| 2012/0036646 | A1 * | 2/2012 | McCausland et al. | 5/713 |

FOREIGN PATENT DOCUMENTS

| | | | |
|---|---|---|---|
| KR | 10-0318300 | B1 | 4/2002 |
| KR | 20-0435149 | Y1 | 1/2007 |
| WO | WO9103971 | | 4/1991 |
| WO | WO2006079059 | A1 | 7/2006 |
| WO | WO2007021878 | A2 | 2/2007 |

OTHER PUBLICATIONS

European Search Report dated Jul. 21, 2011; Serial No. 08838461; priority Serial No. PCT/US2008079485.

* cited by examiner

INFLATABLE CELLULAR MATTRESS WITH ALTERNATING ZONES OF INFLATED CELLS

CROSS REFERENCE TO RELATED APPLICATIONS

This application is a divisional of application Ser. No. 12/682,434, filed Apr. 29, 2010, which is the United States National Stage under 35 U.S.C. §371 of International Application Serial No. PCT/US2008/079485, having an International filing date of Oct. 10, 2008 and is related to, and claims the benefit of U.S. provisional patent application Ser. No. 60/998,643 filed Oct. 12, 2007, all of which are incorporated by reference herein.

BACKGROUND OF THE INVENTION

The invention relates generally to inflatable cushions and mattresses and, more specifically, an inflatable cellular mattress or cushion wherein the inflation pressure in adjacent air cells alternates.

Cushions, mattresses and mattress overlays intended for use by patients to help prevent skin and tissue damage or pressure sores are known. In general, such cushions, mattresses and mattress overlays are provided as fiber or foam filled cushions or mattresses, inflatable cushions or mattresses or inflatable cushions or mattresses comprising a plurality of individual inflatable air cells of various configurations. In general, the goal of such products is to distribute contact pressure or diffuse load over a wider area of the anatomy to reduce pressure points and thereby prevent or ameliorate pressure sores or decubitis ulcers. Although known cushions, mattresses and mattress overlays generally work well for their intended purposes, it is desirable to have such products that include improved means for diffusing load over a wider area.

SUMMARY OF THE INVENTION

A cushion or mattress comprising a base and a plurality of linearly aligned individual air cells across the base. Groups of individual air cells can be interconnected and in fluid cooperation with an inflation source, such as a pump and controller. In one aspect of the invention, the inflation of adjacent cells is staggered, for example, in a checkerboard-like inflation pattern. The alternating inflation patterns break up the pattern of pressure points on the user's anatomy.

DETAILED DESCRIPTION

Figure 1:
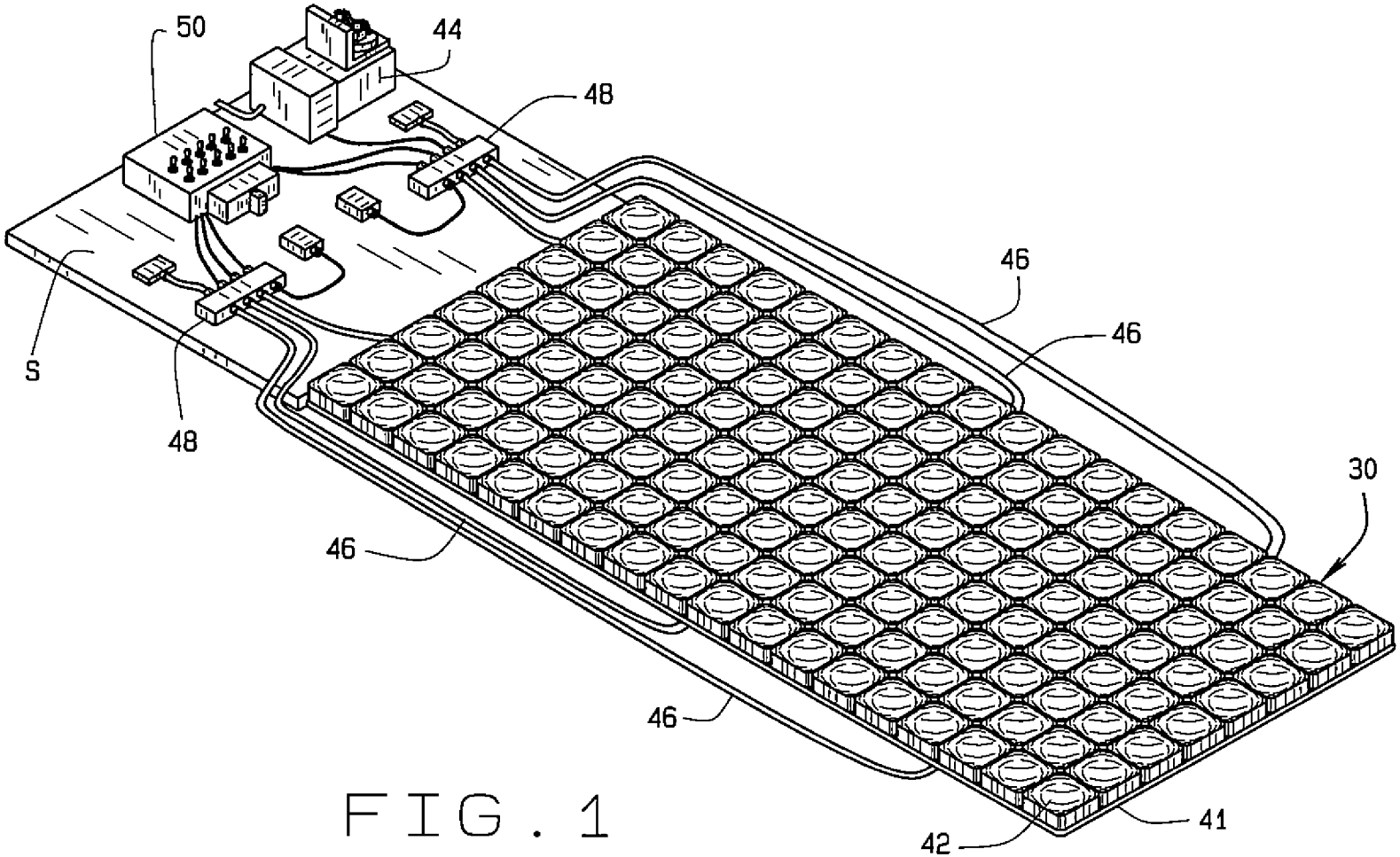
FIG. 1 is a perspective view of a mattress from one end with all the individual inflatable cells deflated.

One aspect of a mattress is indicated generally in figures by reference number 30. Mattress 30 can be comprised of individual sections, for example, three sections 32, 34, and 36, best seen in FIGS. 8 and 13 or two sections with a head section, 32, 34, and 38, as seen in FIGS. 9-12 or three sections and a head and a foot section 32, 34, 38 and 40 (see, e.g. FIGS. 14-16). The use of sections is preferable since a section can be replaced if damaged. However, the mattress can be construction as one piece, without sections. The mattress generally is molded from a plastic or vinyl material that is durable, easily and economically molded and easy to keep clean.

In any event, each section, and hence the mattress as a whole, includes a base 41 with a plurality of linearly aligned individual inflation cells 42 arranged across the base forming longitudinal and transverse rows of individual cells. Individual inflation cells 42 are interconnected as will be discussed in reference to FIGS. 9-16.

As seen in FIGS. 1-6, a mattress 30 generally will include an air source, such as pump 44 operably connected to a group of inflatable cells by hoses 46 so that pump 44 is in fluid communication with a group of cells. Since each mattress section will have two sets of cells for alternate inflation, there are two hoses for each section. Hence, if there are three mattress sections, there would be six (6) hoses (two each section) one each of which is in fluid communication between pump 44 and a set of inflatable cells in a mattress section through a manifold 48. Manifold 48 can have internal valves or there can be a solenoid operated valves positioned at any operative location between the pump and a set of cells to control the inflation and deflation of selected groups of cells.

Mattress 30 also includes a controller 50. Controller 50 can be of any design and configuration that controls the actuation of pump 44 and the distribution of air into the sets of cells through the manifolds or solenoid valves as desired. Controller 50 can be computer operated by appropriately programmed software or can be function through the use of timers and electrical switches. It will be appreciated that the pump, controller and valve arrangement can be of any desired configuration so long as it provides the controlled inflation and deflation of groups of cells as will be described in greater detail.

Figure 5:
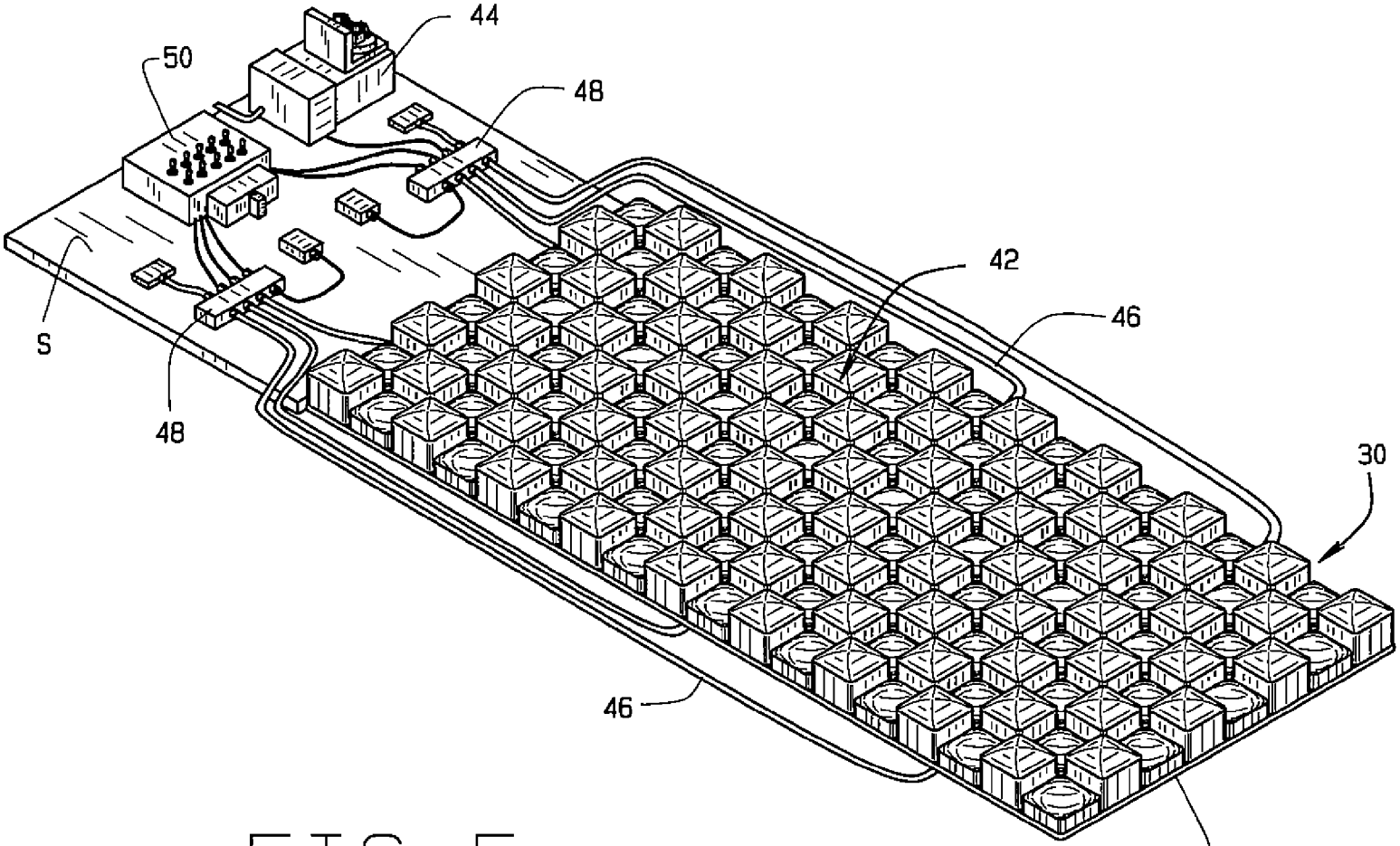
FIG. 5 is a perspective view of a mattress with individual inflatable cells inflated in a staggered pattern.
Figure 6:
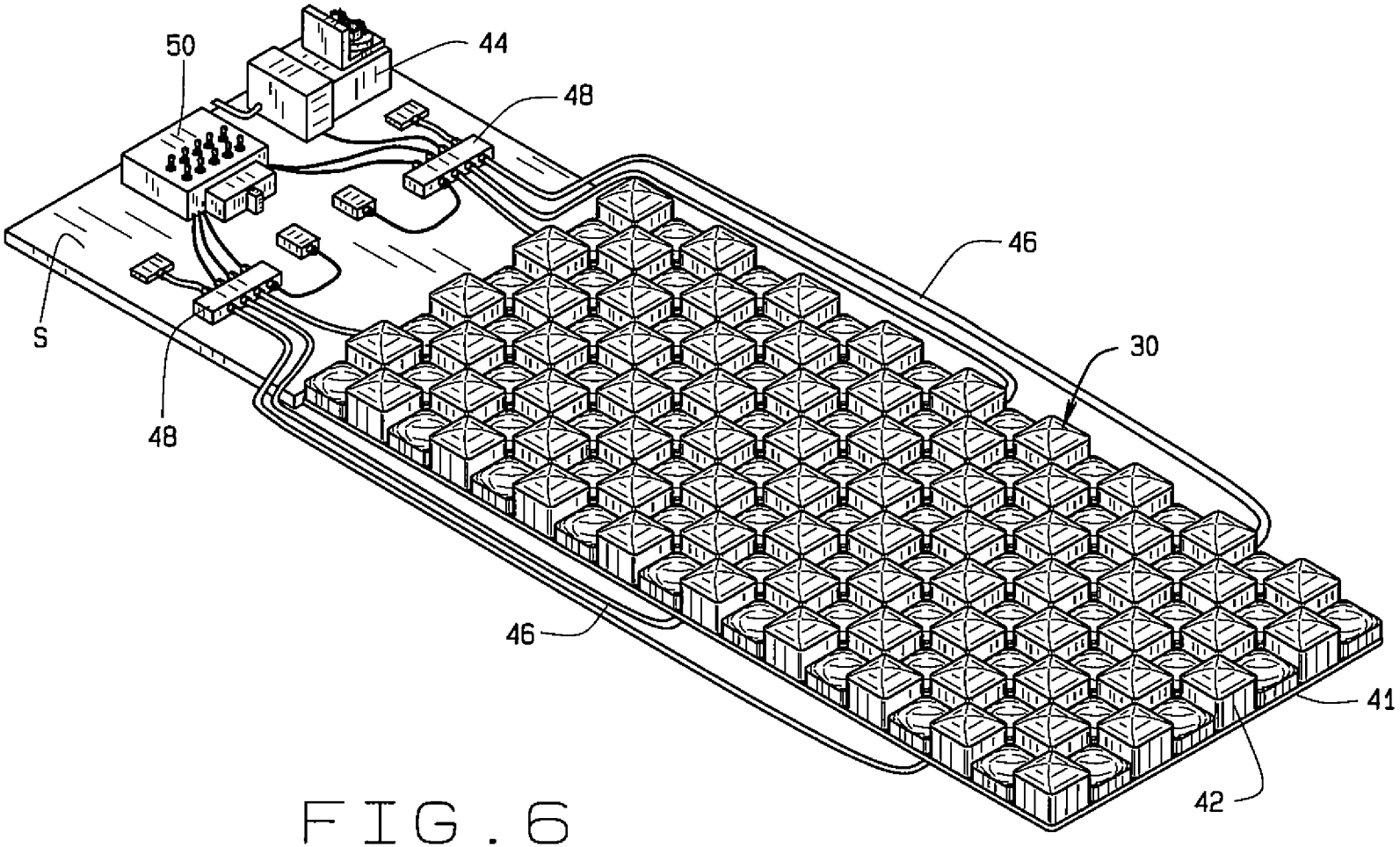
FIG. 6 is a perspective view of the mattress of FIG. 5 with alternate individual inflatable cells inflated in a staggered pattern.

As seen by comparing FIGS. 5 and 6, groups of interconnected cells can be inflated to form a first staggered pattern of inflated cells (FIG. 5) and then an alternate staggered pattern of inflated cells (FIG. 6). For purposes of illustration, the group of inflated cells in FIG. 5 will be referred to as Group A and the group of inflated cells in FIG. 6 will be referred to as Group B. These alternating staggered or "checkerboard" patterns diffuse load of a user positioned on the mattress over a wide area. As will be appreciated, there is no straight line of force. The alternating inflation patterns break up the pattern of pressure points on the user's anatomy. In other words, it increases resolution in a manner analogous to pixels on a video screen.

Figure 2:
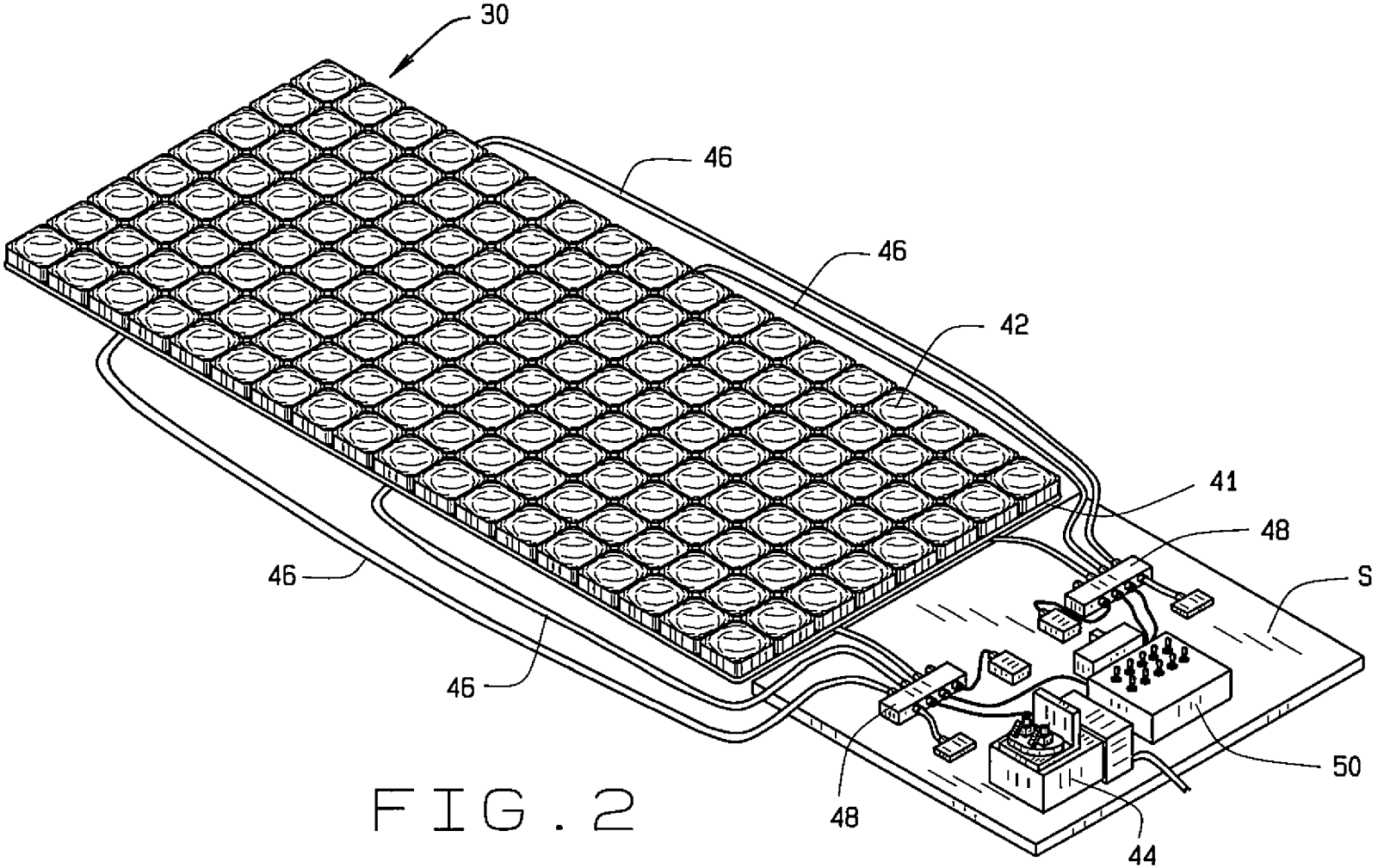
FIG. 2 a perspective view of the mattress of FIG. 1 from the opposite end.
Figure 3:
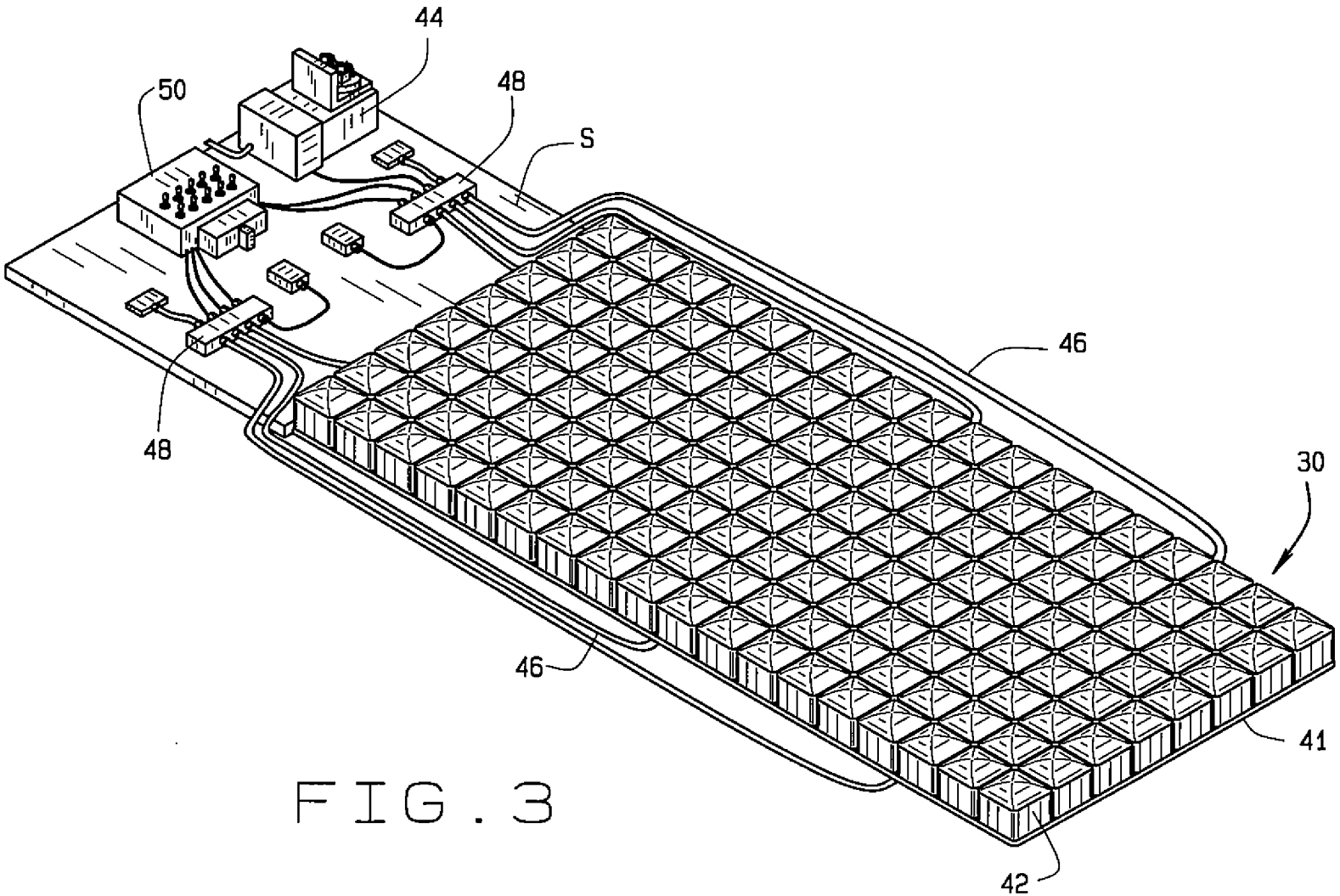
FIG. 3 is a perspective view of a mattress with all the individual inflatable cells inflated at the beginning of a use cycle.
Figure 4:
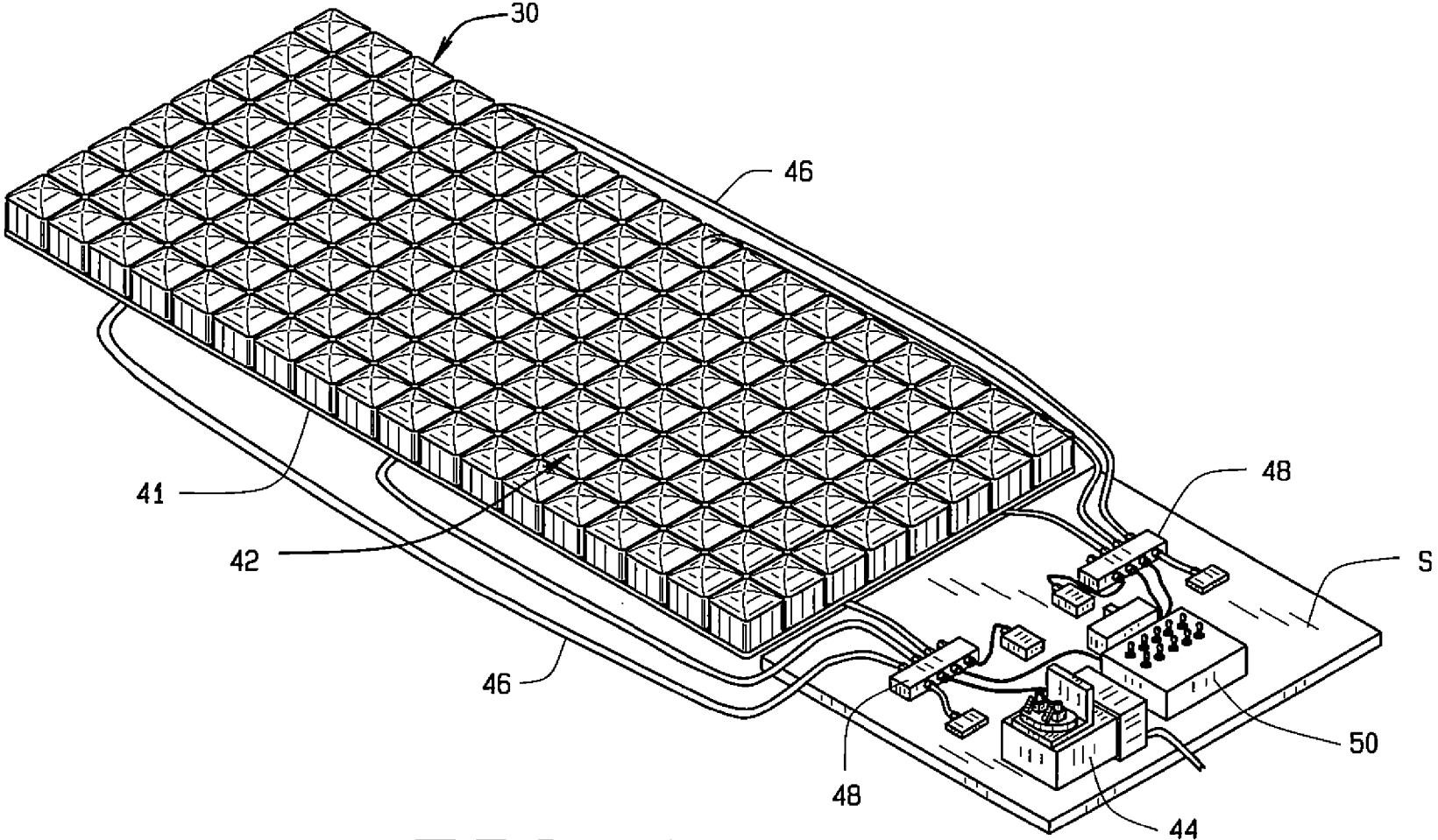
FIG. 4 a perspective view of the mattress of FIG. 3 from the opposite end

Referring to FIGS. 1-6 as well as FIG. 7, one illustrative mode of operation will be described. FIGS. 1 and 2 show the mattress in a completely deflated mode. Pump 44 is actuated and the appropriate valves are opened so that air flows into all the cells for full inflation of the mattress, as shown in FIGS. 3 and 4. This full initial inflation is illustrated on the graphs of FIG. 7 as A Init. Inflate and B Init Inflate. In general, when the cells are inflated, they are inflated to an optimal internal pressure that will maintain a desired interface pressure between a user's body and inflated cells over a broad range of user body sizes for example, a desired interface pressure of about 25 mmHg to about 200 mmHg, preferably between about 25 and about 80 mmHg, but preferably below the body's capillary closing pressure of about 32 to about 35 mmHg, for example about 25 mmHg. By way of example, over the broadest range of conditions, i.e. patient body mass, this may be accomplished by having an air pressure within an inflated cell of approximately 40 mmHg. Of course, the internal cell pressure can be manipulated based upon the user's body mass to arrive at an internal cell pressure that achieves a desired interface pressure.

Figure 7:
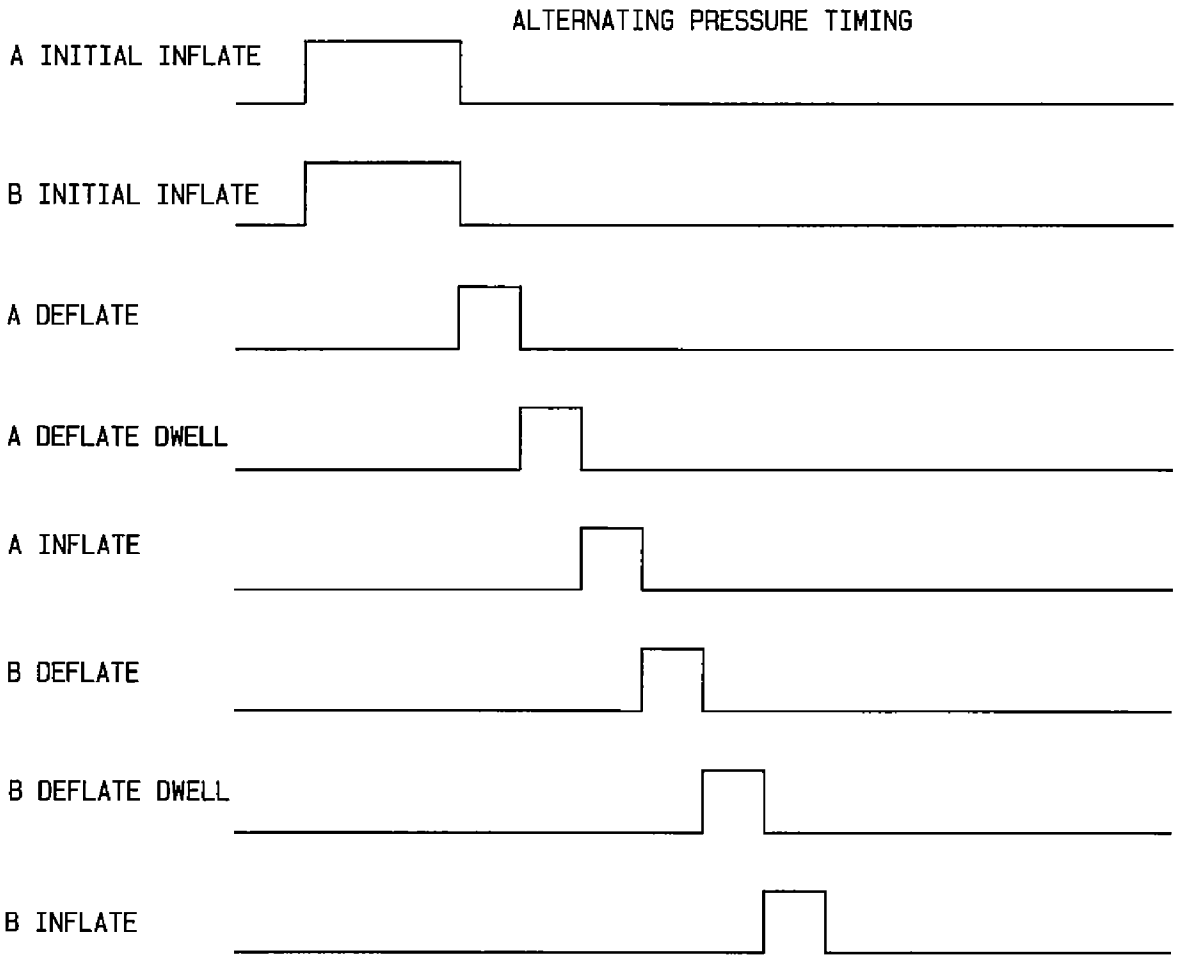
FIG. 7 is a diagram of alternating pressure cycles.

As seen in FIG. 7 the cells in Group A begin a slow deflation (A Deflate) for example, to an interface pressure of approximately 16 mmHg for a predetermined dwell (A Deflate Dwell). There is a predetermined dwell time for the deflated state of Group A, for example, a 60 second dwell. It will be understood that at this time, the cells in Group B remain at their initial inflation pressure. Subsequently, the cells of Group A are slowly inflated, generally at an air flow rate of about 12 $ft.^3$/hour, to the desired interface pressure, e.g. 25 mmHg (A Inflate) and the cells in Group B begin to slowly deflate to a lower interface pressure, e.g. 16 mmHg (B Deflate) and they remain at this lower interface pressure for a predetermined dwell time (B Deflate Dwell) for example, 60 seconds and the cells in Group A remain inflated at the optimum interface pressure. The cells in Group B slowing begin to inflate (B Inflate) and when inflated, the cycle begins over again at the A Deflate line. As will be appreciated, there is a regular pattern of inflation, deflation, deflation dwell for each group of cells that achieves the staggered or checkerboard-type pattern of inflated cells at an optimal interface pressure for an optimal amount of time to achieve a desired result.

Figure 8:
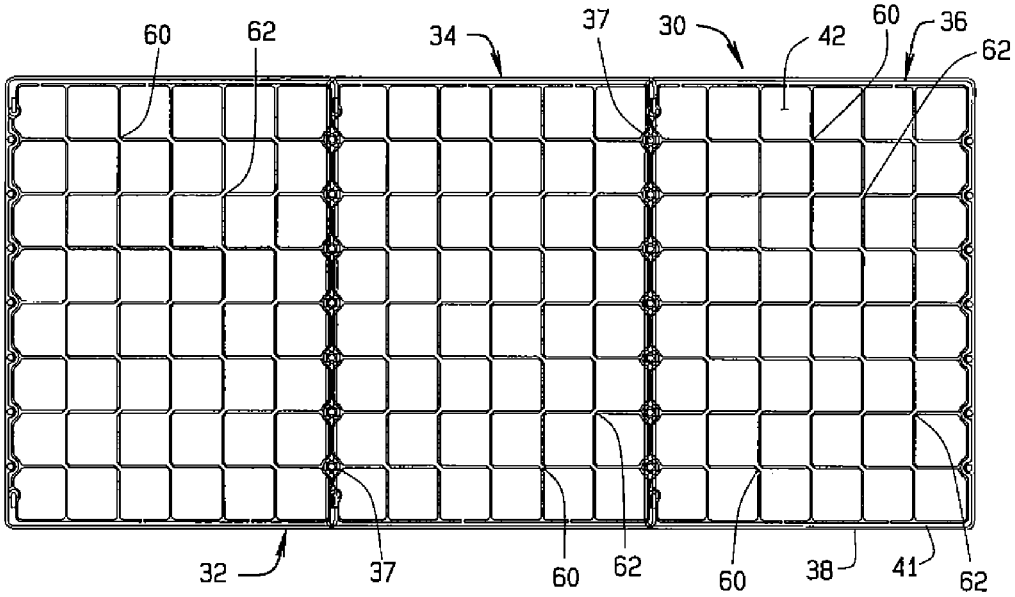
FIG. 8 is a top schematic view of a mattress having three sections with two inflation zones per section.

FIGS. 8-16 illustrate schematically several alternative designs for the mattress. FIG. 8 shows a mattress having three sections 32, 34, and 36 with two inflation zones per section. The mattress is comprised of a base 40 with cells 42 arranged across the base forming longitudinal and transverse rows of individual cells. One group of individual inflation cells 42, are interconnected by airflow pathways 60 and another by airflow pathways 62. As can be seen, the patterns of airflow pathways result in the inflation of the cells in an alternating or checkerboard pattern. As stated above, if there are two inflation zones in a section, then there would be two (2) hoses 46 per section, one each to deliver air to the two zones. Hence, in a mattress having three sections with two zones, there would be six hoses in fluid communication between the mattress and the pump, each controlled by a valve.

Figure 9:
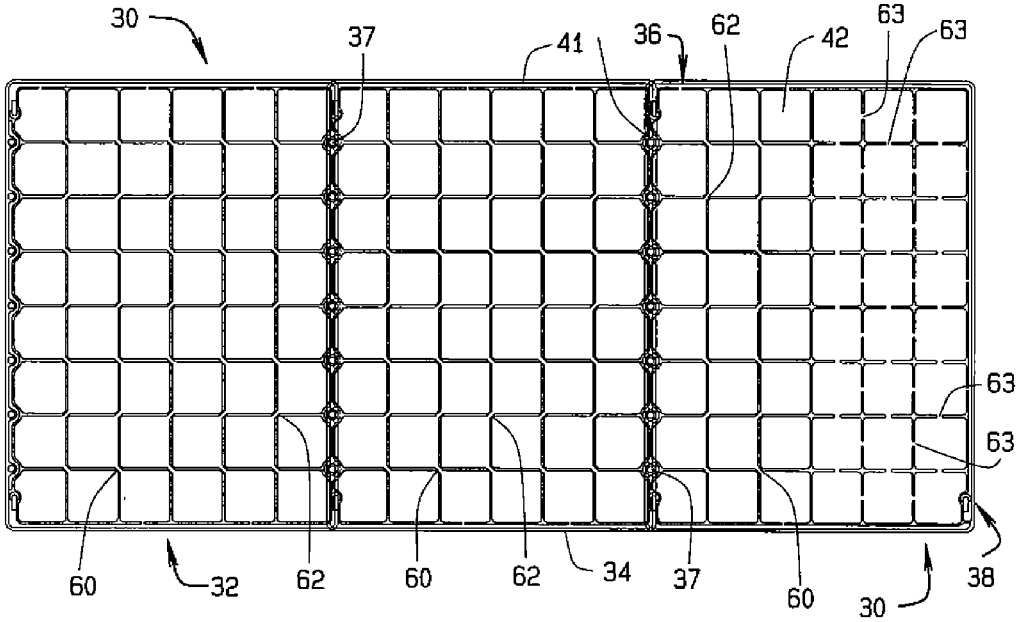
FIG. 9 is a top schematic view of a mattress having three sections with three inflation zones per section.
Figure 10:
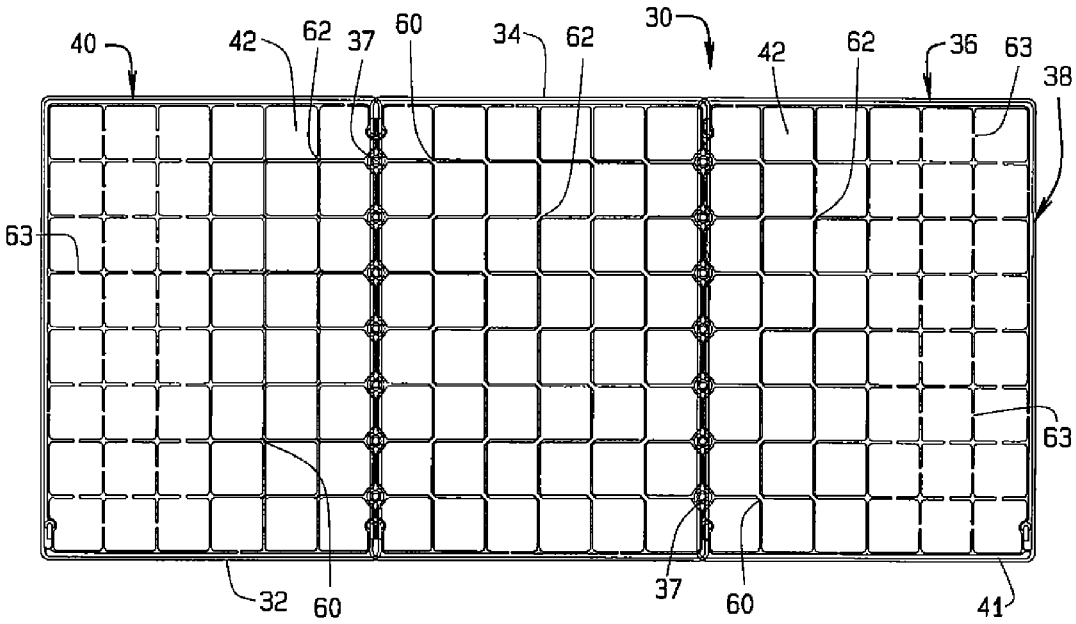
FIG. 10 is a top schematic view of a mattress having three sections with four inflation zones per section.
Figure 11:
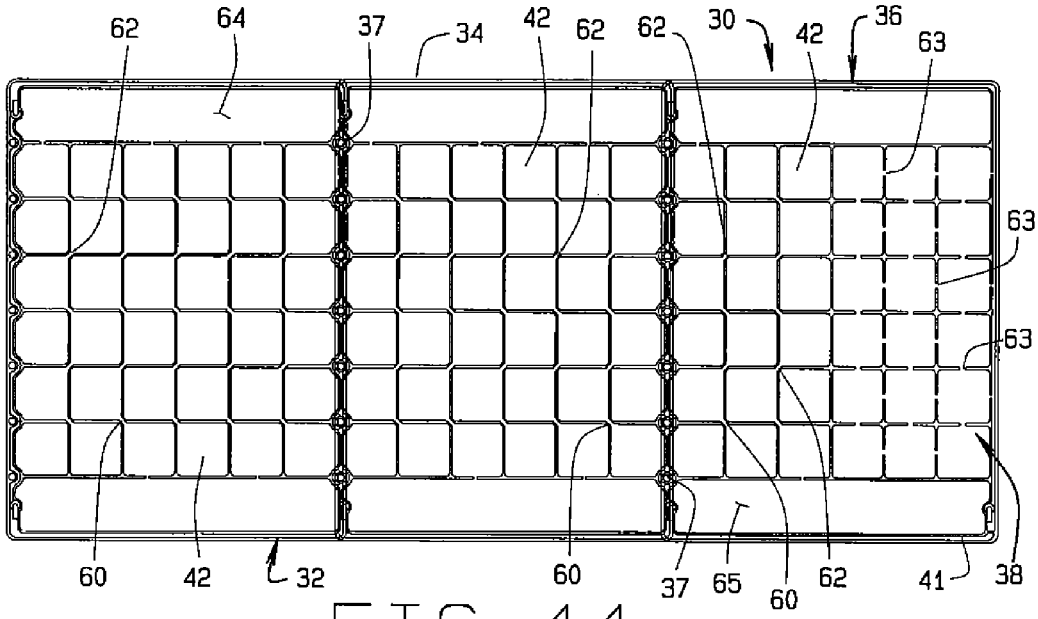
FIG. 11 is a top schematic view of a mattress having a head section and side rails.
Figure 12:
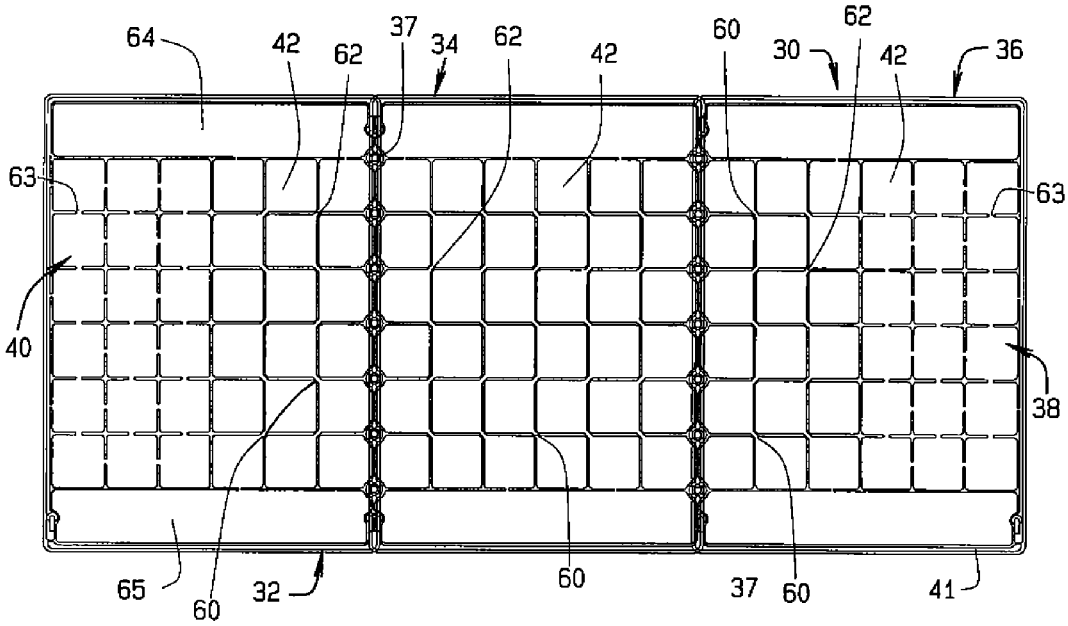
FIG. 12 is another top schematic view of a mattress having a head section and with four inflation zones per section and side rails.
Figure 13:
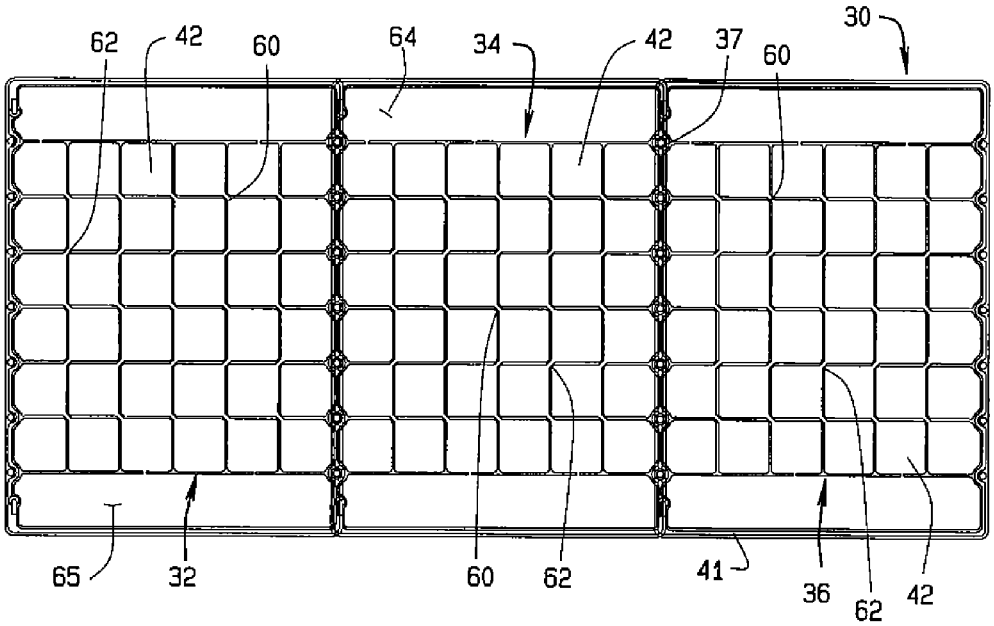
FIG. 13 is a top schematic view of a mattress having three sections with two inflation zones per section and side rails.

FIG. 9 is a top schematic view of a mattress having three sections with three inflation zones per section. FIG. 10 is a top schematic view of a mattress having three sections with four inflation zones per section. FIG. 11 is a top schematic view of a mattress having a head section 38 and side rails 63 and 64. In general, at least a portion of the head section 38 does not include alternating pressure cells (i.e. no airflow pathways between the cells), since that may be an annoyance to some users. This portion is inflated and remains inflated via check valves. Side rails 63 and 64 are inflatable side rails or bolsters. They, as well as the head section 38 are inflated by the same pump and remain inflated at a constant level. Check valves prevent deflation. FIG. 12 is another top schematic view of a mattress having a head 38 section and with four inflation zones per section and side rails 63, 64. FIG. 13 is a top schematic view of a mattress having three sections with two inflation zones per section and side rails 62, 64

Figure 14:
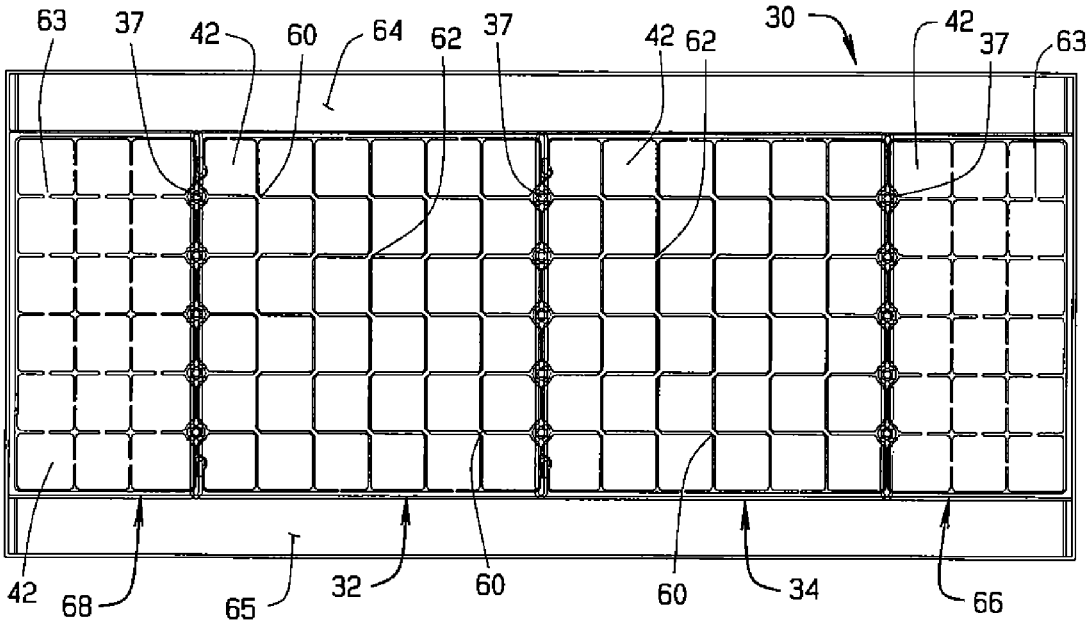
FIG. 14 is top schematic view of a mattress having a head section, a foot section, three inflation zones per section and side rails.
Figure 15:
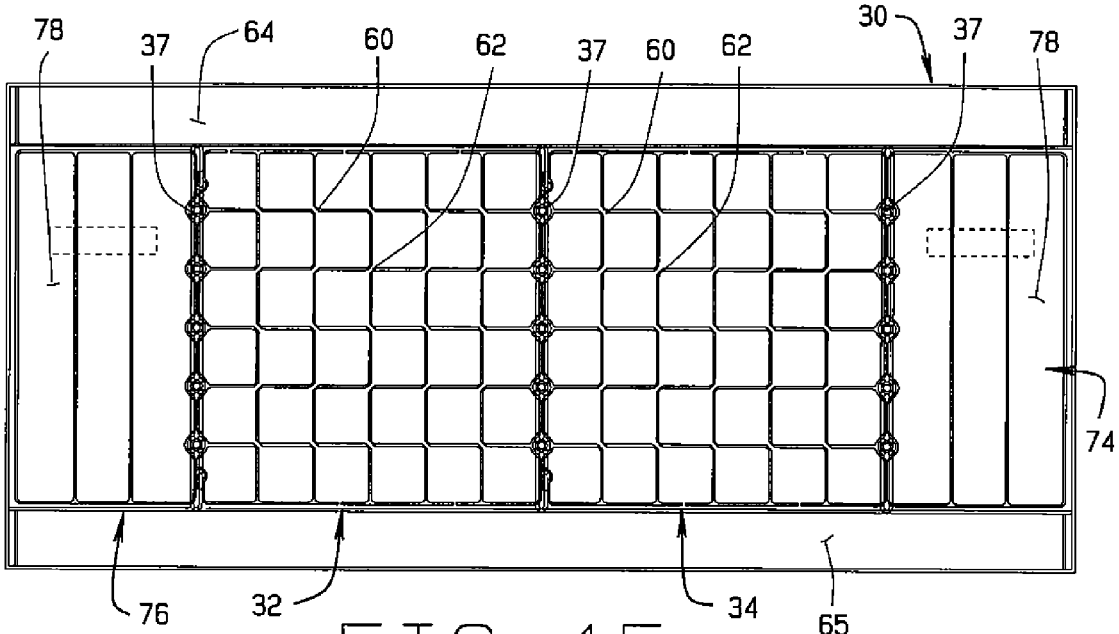
FIG. 15 is top schematic view of a mattress having a head section, a foot section of a different configuration, three inflation zones per section and side rails.
Figure 16:
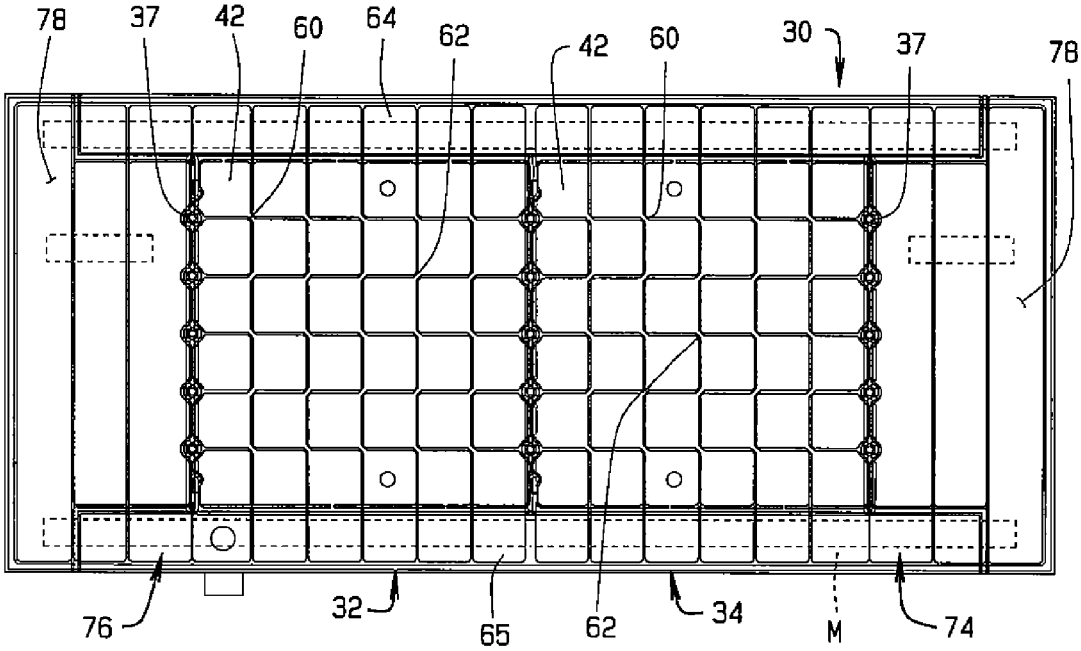
FIG. 16 is top schematic view of a bi-level mattress having a head section, a foot section.

FIG. 14 is top schematic view of a mattress having a head section 38, a foot section 40, and three inflation zones per section and side rails 63, 64. As with the head section and side rails, at least a portion of the foot section generally is inflated and remains at a constant pressure. FIG. 15 is top schematic view of a mattress having a head section 38 and a foot section 40 of a different configuration. The head and foot sections are comprised of elongated inflatable or tubular type inflatable cells 65 that run transverse to the cushion itself. FIG. 16 is top schematic view of a bi-level mattress. The mattress of FIG. 16, as shown, includes a head section 38 and foot section 40. In this embodiment, there is an underlying inflated mattress M that provides support in the event the alternating pressure mattress deflates. This configuration prevents bottoming out.

It will be appreciated from the foregoing that that the arrangement and configurations of the mattress with alternating pressure cells is unlimited. They can have underlying mattresses, head sections, foot sections, or side rails. They can be sectional or one piece. They can have sections that include the alternating pressure air cells or do not include the alternative pressure air cells. They can include low air loss sections as well. Any arrangement or configuration that employs the alternating pressure air cells is intended to fall within the scope of the invention The rate of inflation and deflation, the internal cell pressure and interface pressure can be controlled or adjusted as desired. One skilled in the art will appreciate that individual parameters can be and will be adjusted depending upon patient size and body mass, condition of the user's skin and other factors.

The foregoing is an illustrative embodiment of the broader invention and a best mode of operation currently known to the inventors.

The invention claimed is:

1. A method of alternating inflation of at least two groups of individual inflatable air cells in an air cell mattress or cushion comprising a plurality of inflatable air cells to form an alternating pattern of inflated cells wherein the alternating inflation and deflation of each group of cells results in a staggered checkerboard pattern of inflated and deflated cells for the relief of pressure points on the anatomy of a user of the mattress or cushion, the method comprising the steps of;

Inflating a first group of cells;

Inflating a second group of cells;

deflating the first group of cells at a predetermined rate of deflation over a predetermined period of time, while the second group of cells remains inflated for the same said predetermined period of time;

re-inflating said first group of cells at a predetermined rate of inflation over a predetermined period of time, while the second group of cells remains inflated;

deflating the second group of cells at a predetermined rate of deflation over a predetermined period of time, while the first group of cells remains inflated for the same said predetermined period of time;

re-inflating said second group of cells at a predetermined rate of inflation over a predetermined period of time, while the first group of cells remains inflated; and repeating said steps of deflating and re-inflating alternate groups of cells.

2. The method of claim 1 wherein the inflated group of cells are inflated to an interface pressure between the inflated cells and the user's anatomy of about 25 mmHg to about 200 mmHg.

3. The method of claim 1 wherein the inflated group of cells are inflated to an interface pressure between the inflated cells and the user's anatomy of about 25 mmHg to about 80 mmHg.

4. The method of claim 1 wherein the inflated group of cells are inflated to an interface pressure between the inflated cells and the user's anatomy of about 25 mmHg.

5. The method of claim 1 wherein the inflated group of cells are inflated to an interface pressure between the inflated cells and the user's anatomy of about 40 mmHg.

6. The method of claim 2 wherein the step of deflating the first group of cells comprises deflating the first group of cells to an interface pressure between the inflated cells and the user's anatomy of about 16 mmHg.

7. The method of claim 1 wherein the step of deflating the first group of cells at a predetermined rate of deflation over a predetermined period of time further comprises of deflating the first group of cells and allowing the first group of cells to remain deflated for approximately 60 seconds dwell time.

8. The method of claim 1 wherein the step of re-inflating said first group of cells at a predetermined rate of inflation over a predetermined period of time further comprises re-inflating the first group of cells at an air flow rate of about 12 $ft.^3$ per hour.

9. The method of claim 1 wherein the step of deflating the second group of comprises deflating the second group of cells to an interface pressure between the inflated cells and the user's anatomy of about 16 mmHg.

10. The method of claim 1 wherein the step of deflating the second group of cells at a predetermined rate of deflation over a predetermined period of time further comprises of deflating the second group of cells and allowing the second group of cells to remain deflated for approximately 60 seconds dwell time.

11. The method of claim 1 wherein the step of re-inflating said second group of cells at a predetermined rate of inflation over a predetermined period of time further comprises re-inflating the second group of cells at an air flow rate of about 12 $ft.^3$ per hour.

12. The method of claim 1 further comprising the step of controlling the recited inflation, deflation and re-inflation through a controller operatively associated with the mattress or cushion.

13. A method of alternating inflation of at least two groups of individual inflatable air cells in an air cell mattress or cushion comprising a plurality of inflatable air cells to form an alternating pattern of inflated cells wherein the alternating inflation and deflation of each group of cells results in a staggered checkerboard pattern of inflated and deflated cells for the relief of pressure points on the anatomy of a user of the mattress or cushion, the method comprising the steps of:

Inflating all of the inflatable air cells to an interface pressure between the inflated cells and the user's anatomy of about 25 mmHg to about 200 mmHg;

deflating a first group of cells at a predetermined rate of deflation over a predetermined period of time to an interface pressure between the inflated cells and the user's anatomy of about 16 mmHg, while a second group of cells remains inflated for the same said predetermined period of time;

re-inflating said first group of cells at a predetermined rate of inflation over a predetermined period of time to an interface pressure between the inflated cells and the user's anatomy of about 25 mmHg to about 200 mmHg; while the second group of cells remains inflated for the same predetermined period of time;

deflating the second group of cells at a predetermined rate of deflation over a predetermined period of time to an interface pressure between the inflated cells and the user's anatomy of about 16 mmHg, while the first group of cells remains inflated for the same said predetermined period of time;

re-inflating said second group of cells at a predetermined rate of inflation over a predetermined period of time to an interface pressure between the inflated cells and the user's anatomy of about 25 mmHg to about 200 mmHg, while the first group of cells remains inflated; and repeating the aforestated steps of deflating and re-inflating the groups of cells.

14. The method of claim 13 further comprising the step of controlling the recited inflation, deflation and re-inflation with a controller operatively associated with the mattress or cushion

15. The method of claim 14 wherein the controller comprises a programmable computer.

16. The method of claim 13 wherein the steps of inflation and re-inflation are performed through a manifold in fluid communication with the mattress or cushion.

17. The method of claim 16 wherein the steps of inflation and re-inflation are performed by a pump through the manifold in fluid communication with the mattress or cushion.

18. The method of claim 17 wherein the steps of inflation, deflation, and re-inflation are controlled by a programmed controller operatively associated with the pump.

* * * * *